US006216290B1

(12) United States Patent
Zemitis et al.

(10) Patent No.: US 6,216,290 B1
(45) Date of Patent: Apr. 17, 2001

(54) EXPANDABLE SLEEPING BAG

(75) Inventors: Martin Steven Zemitis; Phillip Bayerd Scott, both of Berkeley, CA (US)

(73) Assignee: Mountain Hardwear, Inc., Richmond, CA (US)

( * ) Notice: Subject to any disclaimer, the term of this patent is extended or adjusted under 35 U.S.C. 154(b) by 0 days.

(21) Appl. No.: 09/542,801

(22) Filed: Apr. 4, 2000

(51) Int. Cl.[7] ..... A47G 9/08
(52) U.S. Cl. ..... 5/413 R; 2/69.5; 112/475.08
(58) Field of Search ..... 5/413 R, 413 AM; 2/69, 69.5; 112/475.08

(56) References Cited

U.S. PATENT DOCUMENTS 4,090,269 * 5/1978 Hunt ..... 5/413 R
5,386,602 * 2/1995 Krenzler ..... 5/413 R
5,490,294 * 2/1996 Kramer ..... 5/413 R

* cited by examiner

*Primary Examiner*—Alexander Grosz
(74) *Attorney, Agent, or Firm*—Jay P. Hendrickson

(57) ABSTRACT

An expandable sleeping bag comprising a modified draft tube design incorporating a draft tube expansion segment and expansion zipper which are used to expand the circumferential measurement of the sleeping bag's inner lining and outer shell.

18 Claims, 7 Drawing Sheets

EXPANDABLE SLEEPING BAG

BACKGROUND OF THE INVENTION

Since the first patents issued for sleeping bags in the 1930's, many improvements in sleeping bag design have been developed. Today, sleeping bags are made of extremely lightweight materials and provide substantially improved thermal insulation. In order to maximize the bag's thermal insulation capacity, mummy shaped bags have been developed to reduce the volume of air inside the bag, which enhances thermal efficiency because the user's body heat will be able to more efficiently warm a smaller volume of air. Another important improvement in sleeping bag design has been the development of the draft tube. A draft tube is a longitudinal insulation filled tube, which is attached to the inner lining of a sleeping bag and adjacent to the access zipper which is normally located on the side of the sleeping bag. The function of the draft tube is to overlay the inside surface of the zipper when the zipper is closed, so as to partially block the flow of warm air from the inside of the sleeping bag out through the zipper. The primary problem associated with mummy style sleeping bags is that while they are warmer than wider bags, they are relatively confining and uncomfortable. Wide bags, while more comfortable in warmer conditions, are by nature not as warm when the temperature drops such that the user may be uncomfortably cold. As a result, there is a need for a sleeping bag which essentially retains the thermal insulating benefits of a mummy style sleeping bag and draft tube, but is also comfortable and less confining during more moderate temperatures. The present invention satisfies that need.

SUMMARY OF THE INVENTION

The present invention recognizes that the general design and location of prior art draft tubes provide an ideal combination for realizing the goal of increasing the comfort of a mummy style sleeping bag when it is used during moderate temperatures, and without any loss of thermal efficiency when it is used during more severe conditions. The design of prior art draft tubes is used, with a new and unique modification, to provide the additional fabric needed to expand the sleeping bag, and the draft tube's location is utilized to ensure that the expanded bag is comfortable.

In prior art sleeping bags the draft tube is made from an elongated and generally rectangular shaped piece of fabric, having two opposite longitudinal draft tube edges. In general, as shown in FIG. 1, the fabric is used to form a draft tube by sewing one draft tube edge to the sleeping bag's inner lining, and the other draft tube edge is sewn to the fabric strip of an access zipper, which are in turn sewn to the longitudinal edges of the sleeping bag's inner lining and outer shell. Thermal insulation is placed inside the draft tube and its two ends are sewn closed. The draft tube extends a predetermined distance into the inner portion of the sleeping bag so that it overlays the access zipper.

The present invention modifies the prior art draft tube design by incorporating two additional features into the draft tube and sleeping bag, which are utilized when the draft tube is attached to the inner lining and outer shell of the sleeping bag. One feature is an elongated expansion zipper and the other is an elongated expansion segment. One of the draft tube's longitudinal edges is attached in the usual manner to the sleeping bag's inner lining, but after the other longitudinal draft tube edge is attached to the access zipper's fabric strip, those two components are not then sewn to the longitudinal edges of the sleeping bag's inner lining and outer shell edges. Rather, the other longitudinal draft tube edge and its associated access zipper's fabric strip are also sewn to the longitudinal edge of the expansion segment and the fabric strip of the expansion zipper. Next, the other longitudinal edge of the expansion segment and the other access zipper's fabric strip are sewn together, which are also sewn to the longitudinal edges of the sleeping bag's inner lining and outer shell. Before thermal insulation is placed inside the modified draft tube, one of its two ends are sewn closed, and after filling the draft tube with insulation material, the other end is sewn closed. Further, as in the prior art design, the modified draft tube extends a predetermined distance into the inner portion of the sleeping bag so that it overlays the access zipper. When the expansion zipper is unzipped, the circumferential dimension of the sleeping bag's inner lining and outer shell both increase the same proportional amount. Although the distance that the modified draft tube extends across the access zipper is reduced when the sleeping bag is expanded, the draft tube still overlays the access zipper, because the distance the modified draft tube extends across the access zipper when the sleeping bag is not expanded, is increased a predetermined amount, which is proportional to the increase in the sleeping bag's circumference when it is expanded. Thus, the present invention's modified draft tube continues to provide the important insulating function of a prior art draft tube, and the additional function of permitting the sleeping bag's user to expand the bag without adding any significant modification to the bag's inner lining, which would otherwise make the sleeping bag less comfortable.

DETAILED DESCRIPTION OF THE PREFERRED EMBODIMENT

The general design of the sleeping bag of the present invention is similar to that in popular use today, in which the sleeping bag has an outer shell and an inner lining with insulation material placed within the space between the shell and lining. The open or head opening end of the bag is designed to accommodate the user's head and includes a casing and draw string. The bottom of the sleeping bag is usually formed by providing lining and shell end pieces which are sewn into the circumferential dimensions of the lining and shell, respectively, and the circumferential seam formed by sewing the shell end piece to the shell forms the bottom circumferential edge of the bottom end of the sleeping bag. The user's entry and exit from the sleeping bag is facilitated by a longitudinal access zipper which extends, normally along the side of the bag, from the open end to the bottom end of the bag.

Figure 1:
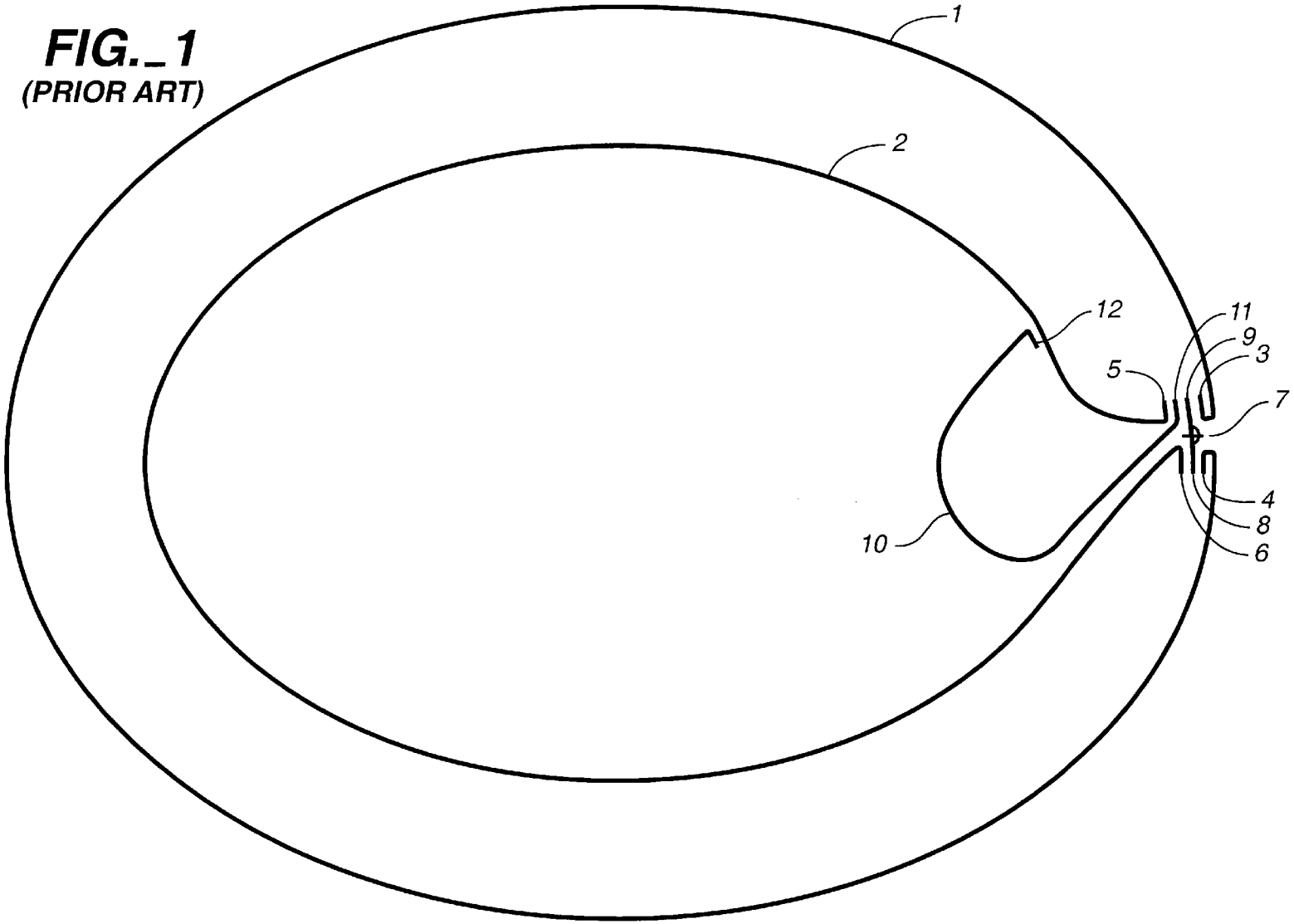
FIG. 1 (PRIOR ART)
FIG. 1 illustrates a cross section of a prior art sleeping bag containing a draft tube.

In prior art sleeping bags, the access zipper is sewn into the bag at the time the outer shell and inner lining are formed from sheets of fabric into concentric tubes. Referring to FIG. 1, the sleeping bag's outer shell 1 is formed by mating opposite, longitudinal shell edges 3 and 4 of the shell fabric, and the inner lining 2 is similarly formed by mating opposite, longitudinal inner lining edges 5 and 6 of the lining fabric. The mated edges are positioned such that one of the shell edges is adjacent to and overlaps with an inner lining edge to form a pair of sleeping bag overlapped edges 3 and 5, and the other shell edge is positioned to be adjacent to and overlapping with the other lining edge to form another pair of sleeping bag overlapped edges 4 and 6. An access zipper 7 is then positioned longitudinally between the pair of sleeping bag overlapped edges such that one of the access zipper's fabric strips 8 is mated to and overlapped with one of the pair of sleeping bag overlapped edges 4 and 6, and each of these overlapped fabric parts are sewn together to form a first seam, which extends into the inner portion of the sleeping bag and secures one side of the access zipper to the sleeping bag. The other access zipper strip 9 is also mated to and overlapped with the other pair of sleeping bag overlapped edges 3 and 5, but before these overlapped fabric parts are sewn together, a draft tube 10 is positioned adjacent to the sleeping bag's inner lining 2 and to the access zipper's fabric strip 9 and its associated sleeping bag overlapped edges 3 and 5. The draft tube 10 is formed from a rectangularly shaped piece of fabric, which is usually the same length as the length of the sleeping bag. A longitudinal draft tube edge 11 is mated to and overlapped with the access zipper's fabric strip 9 and its associated sleeping bag overlapped edges 3 and 5, and these mated and overlapped edges are sewn together to form a second seam, which also extends into the inner portion of the sleeping bag and secures the other side of the access zipper to the sleeping bag. The opposite longitudinal draft tube edge 12 is then overlapped with and sewn to the sleeping bag's inner lining 2, adjacent to the second seam. Finally, one end of the draft tube 10 is sewn closed, the draft tube 10 is filled with insulation material, and the other end is also sewn closed.

Figure 2:
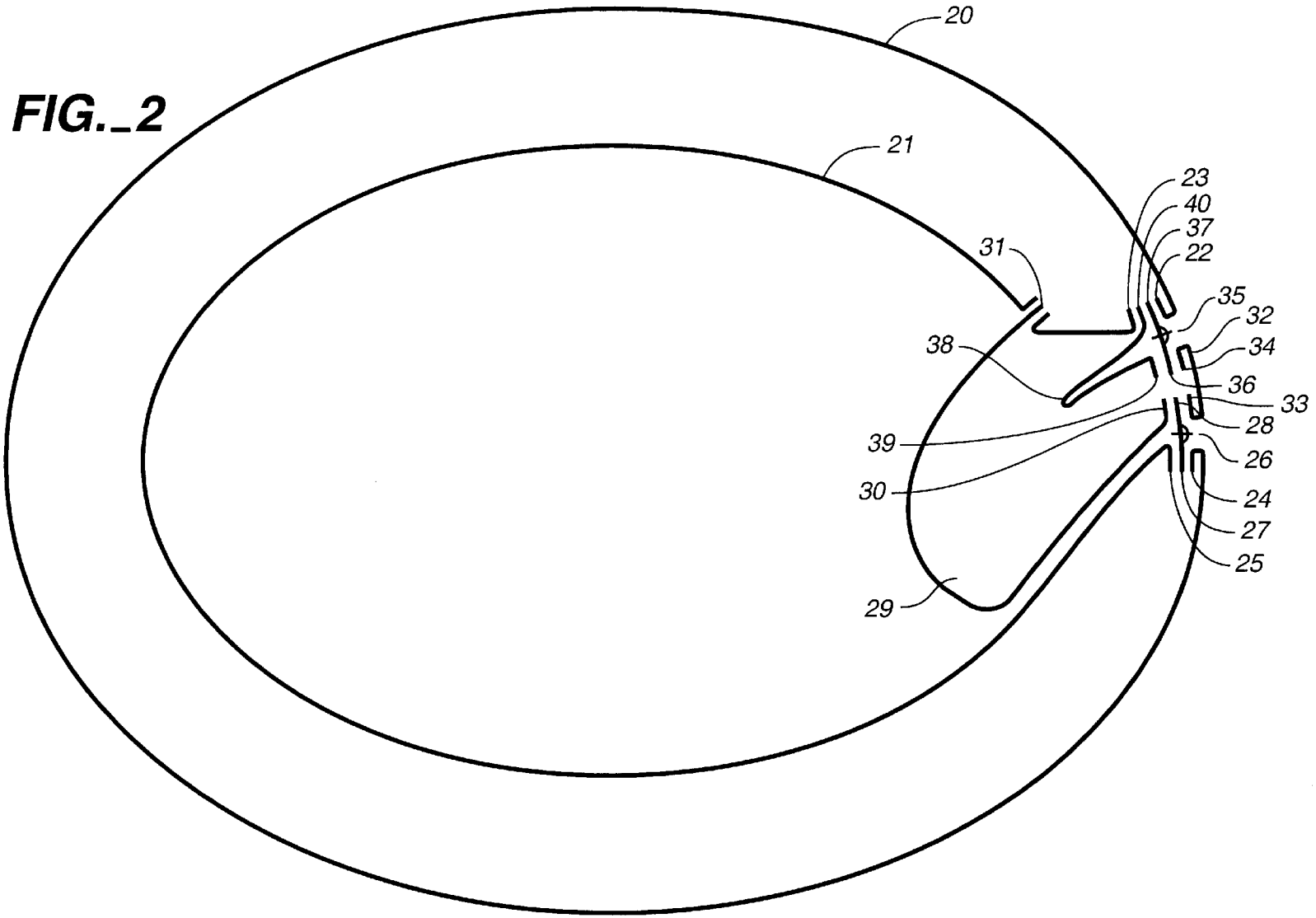
FIG. 2 illustrates a cross section of the present invention's modified draft tube and sleeping bag in an unexpanded state.
Figure 3:
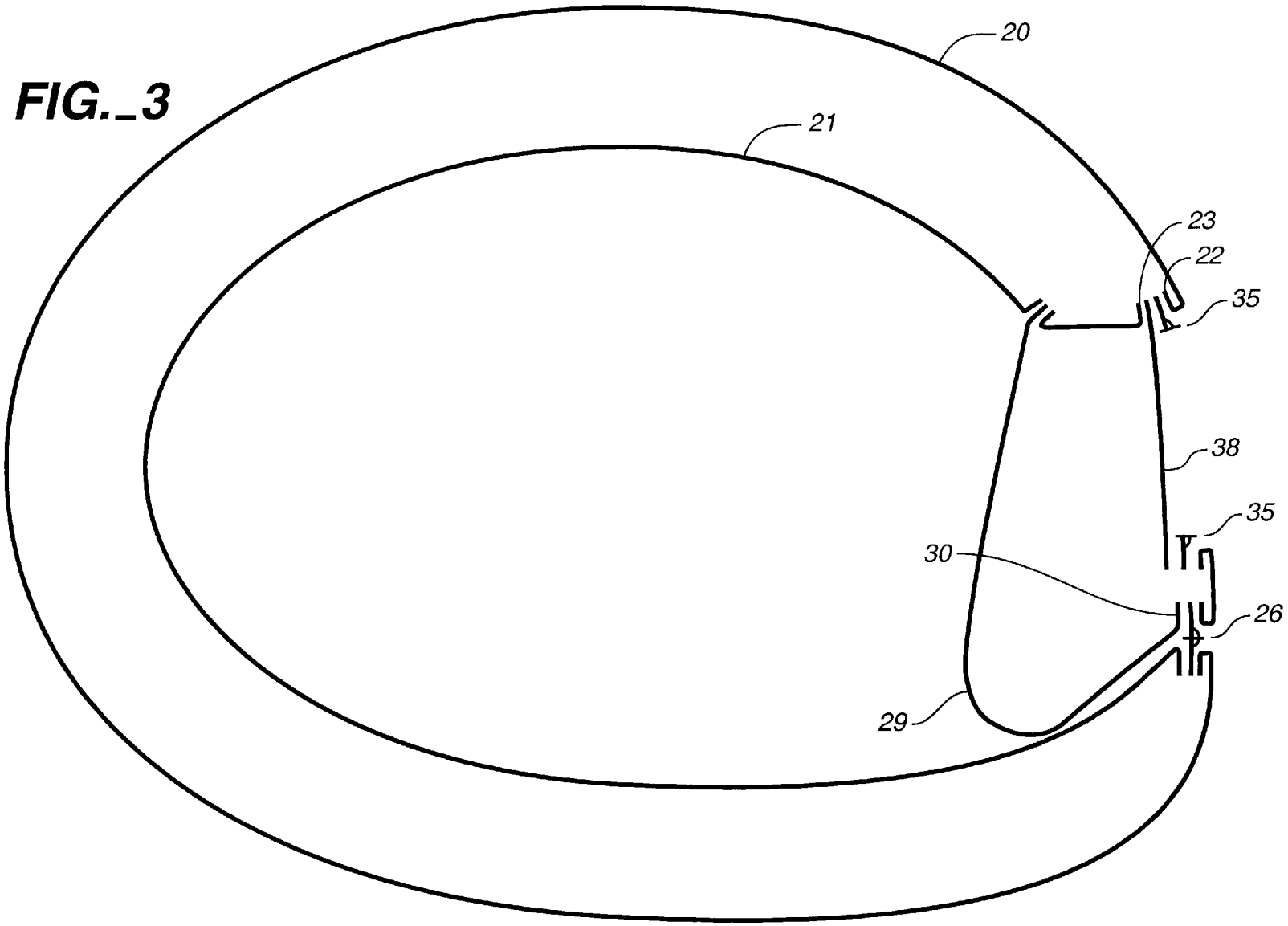
FIG. 3 illustrates a cross section of the present invention's modified draft tube and sleeping bag in an expanded state.

The improvement which comprises the present invention is described by making reference to FIG. 2 which illustrates the preferred embodiment of the expandable sleeping bag in its unexpanded condition, and FIG. 3 which shows the same sleeping bag in its expanded state. As illustrated in FIG. 2, a sleeping bag outer shell 20 and inner lining 21 are constructed in the same manner as that described above in connection with the prior art sleeping bag illustrated in FIG. 1. A longitudinal shell edge 22 is mated to and overlapped with a longitudinal lining edge 23 to form a pair of sleeping bag overlapped edges 22 and 23. Similarly, an opposite, longitudinal shell edge 24 is mated to and overlapped with an opposite, longitudinal lining edge 25 to form another pair of sleeping bag overlapped edges 24 and 25. An access zipper 26 is positioned longitudinally between the pair of sleeping bag overlapped edges such that one of the zipper's fabric strips 27 is mated to and overlapped with one of the pair of sleeping bag overlapped edges 24 and 25, and each of these overlapping fabric parts are sewn together to form a first seam, which extends into the inner portion of the sleeping bag and secures one side of the access zipper 26 to the sleeping bag. The other access zipper strip 28, however, is not mated to the other pair of sleeping bag overlapped edges 22 and 23 as in the prior art design. Rather, the other access zipper strip 28 is mated to and overlapped with a longitudinal draft tube edge 30 of a draft tube 29 and a longitudinal front piece edge 33 of an elongated, rectangularly shaped front piece 32. Each of these overlapping fabric parts are then sewn together to form a second seam. An expansion zipper fabric strip 36 of an expansion zipper 35 is then mated to and overlapped with a longitudinal draft tube expansion segment edge 39 of an elongated rectangularly shaped draft tube expansion segment 38 and an opposite longitudinal front piece edge 34 of the front piece 32. Each of these overlapping fabric parts are sewn together to form a third seam. The other expansion zipper fabric strip 37 of the expansion zipper 35 is next mated to and overlapped with the other unsewn pair of sleeping bag edges 22 and 23, and mated to and overlapped with an opposite longitudinal draft tube expansion segment edge 40 of the draft tube expansion segment 38. Each of these overlapped fabric parts are sewn together to form a fourth seam. The construction is completed by overlapping and sewing an opposite longitudinal draft tube edge 31 to the sleeping bag's inner lining 21, which is adjacent to the fourth seam. Finally, one end of the draft tube 29 is sewn closed, the draft tube 29 is filled with insulation material, and the other end is also sewn closed.

Figure 4:
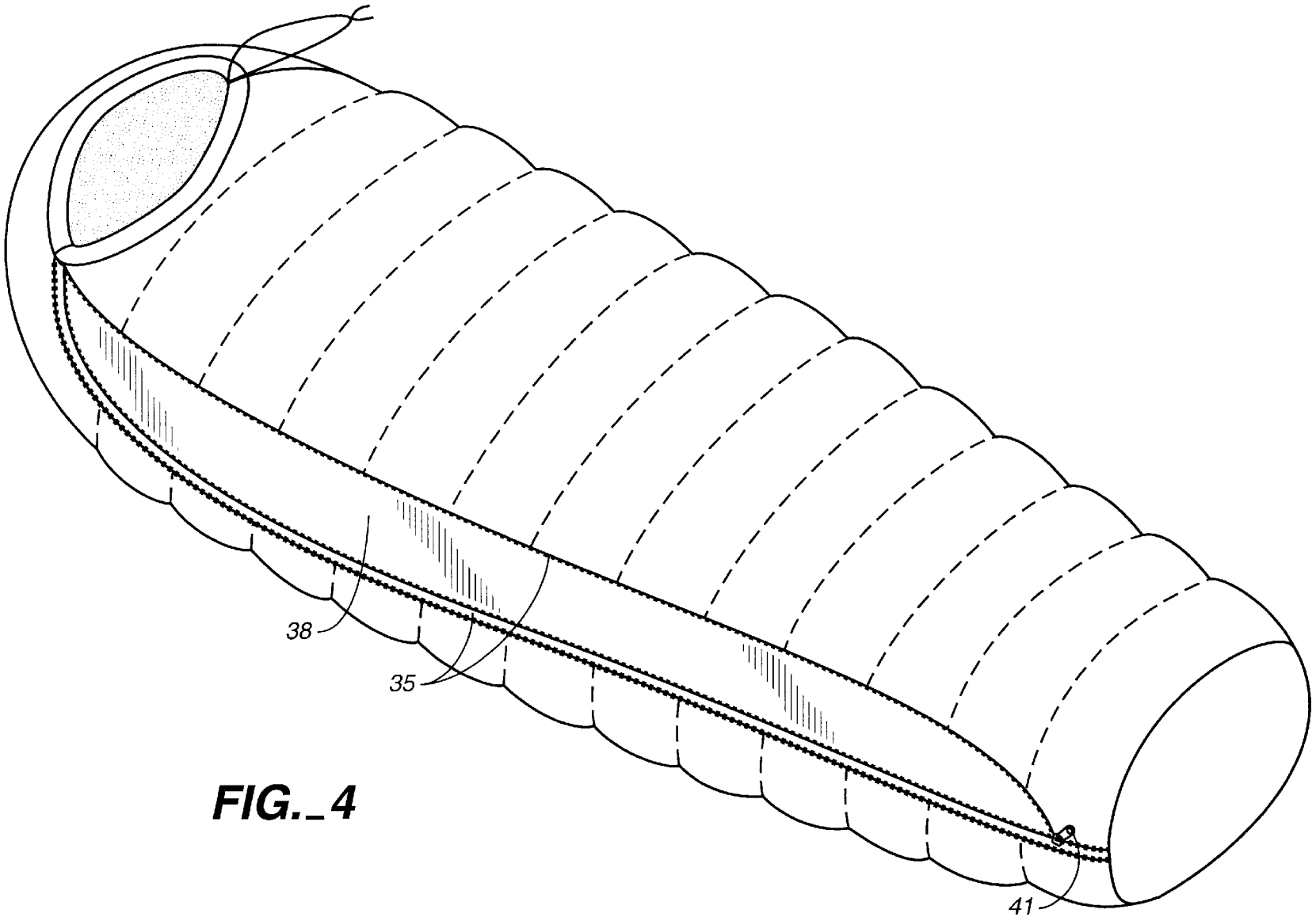
FIG. 4 is a perspective view of the present invention's modified draft tube and sleeping bag in an expanded state.

In FIG. 3 and FIG. 4, an expansion zipper slider 41 of the expansion zipper 35 has been unzipped from the sleeping bag's head opening to the edge of the bottom end of the bag to allow the draft tube expansion segment 38 to expand along the length of the sleeping bag. As may be more readily seen by referring to FIG. 3, the expansion segment 38 constitutes a direct connection between the draft tube edge 30 of the draft tube 29 and the pair of edges 22 and 23 of the sleeping bag's outer shell 20 and inner lining 21, respectively. Thus, expansion of the draft tube expansion segment 38 causes the circumferential dimensions of the sleeping bag's outer shell 20 and inner lining 21 to increase uniformly along the length of the bag. At the same time, the distance that the draft tube extends across the access zipper 26 is reduced in proportion to the increase in the circumference of the outer shell 20 and inner lining 21. The draft tube 29, however, continues to perform its important function of blocking or retarding the flow of warm air from inside the sleeping bag out through the access zipper 26, because the distance the modified draft tube extends across the zipper 26 when the sleeping bag is not expanded, is increased a predetermined amount, which is proportional to the increase in the sleeping bag's circumference when it is expanded.

Thus, the modified draft tube design of the present invention retains the important insulating function of a prior art draft tube, and the additional feature of providing a more comfortable sleeping bag by permitting the user to increase the circumferential dimension of the sleeping bag's inner lining and outer shell. It is also significant that the expandable feature of the sleeping bag is accomplished without adding any substantial modification to the sleeping bag's inner lining. The only change that the user might notice is a slight increase in the distance the modified draft tube extends across the access zipper. But this slight change should be relatively insignificant from the user's perspective, compared to the addition of a sleeping bag expansion segment and expansion zipper, which might be located along another portion of the bag. This hypothetical sleeping bag would, in effect, create another "draft tube like" projection into the sleeping bag's interior, when the bag was in its unexpanded condition. Thus, rather than providing the ability to enhance the user's comfort, this hypothetical sleeping bag would actually create a bag which would be substantially less comfortable than prior art bags with draft tubes.

Figure 5:
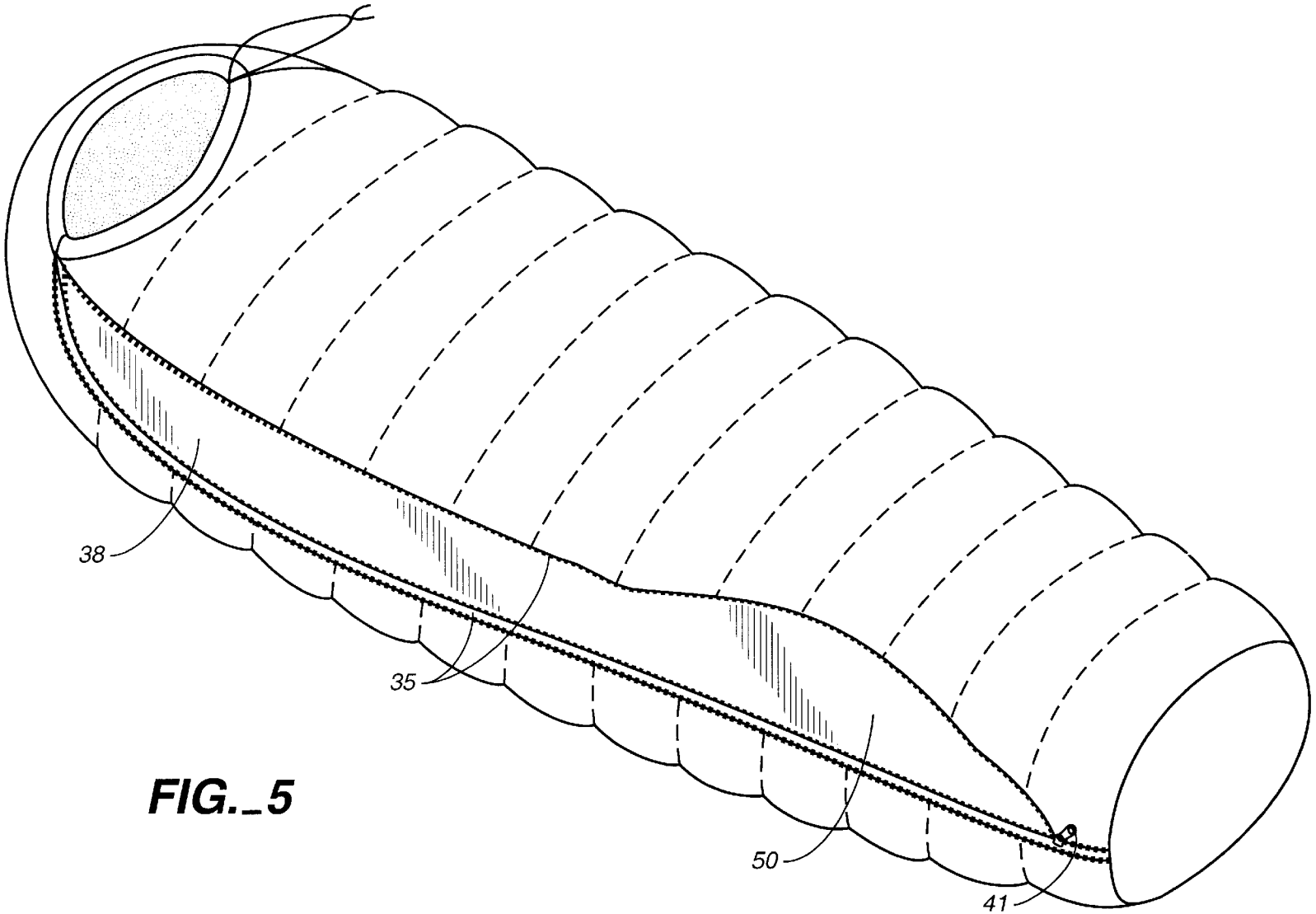
FIG. 5 is a perspective view of the present invention's modified draft tube and sleeping bag in an expanded state, further illustrating the sleeping bag expanded an additional amount in the user's knee area.

In addition to enhancing the user's comfort by uniformly increasing the circumferential dimension of the sleeping bag's inner lining and outer shell, the present invention also includes the feature of varying the amount that the circumferential dimension of the inner lining and outer shell are increased along the length of the sleeping bag. This feature is provided by varying the width of the rectangularly shaped, elongated draft tube expansion segment 38. For example, in another embodiment, FIG. 5 illustrates the expandable sleeping bag of the present invention in which the expansion slider 41 of expansion zipper 35 is unzipped and the width of the expansion segment 38 is increased in the knee area to provide a knee expansion segment 50. Thus, the user's comfort is further enhanced when the sleeping is expanded. It will be readily apparent to those skilled in the art that many different configurations are also possible, for example increasing the width of the expansion segment 38 in the arm and shoulder area, coupled with an increase in the knee area.

Figure 6:
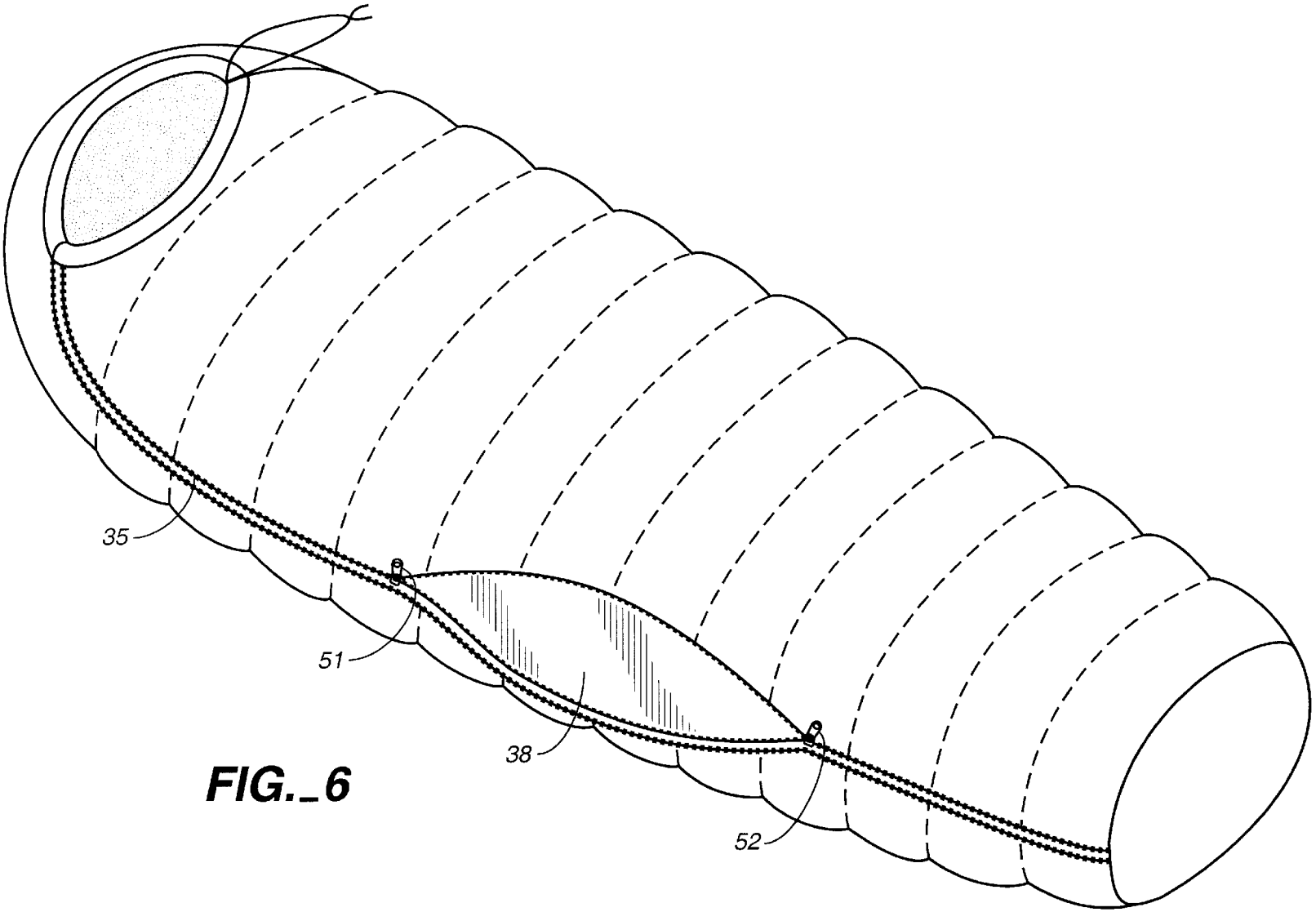
FIG. 6 is a perspective view of the present invention's modified draft tube and sleeping bag in an expanded state, also illustrating the sleeping bag expanded an additional amount in the user's knee area.

The present invention also includes another manner of increasing the user's comfort by varying the amount that the inner lining and outer shell are increased. As illustrated in FIG. 6, the expansion zipper 35 is provided with two zipper sliders 51 and 52, which permit the user to expand different lengthwise portions of the expansion segment 38 by varying the relative location of the two zipper sliders 51 and 52. It will also be recognized by those skilled in the art, that the methods of varying the circumferential dimension as illustrated in FIGS. 5 and 6 can be combined into a single sleeping bag design by varying the width of the expansion segment and providing two or more zipper sliders.

Figure 7:
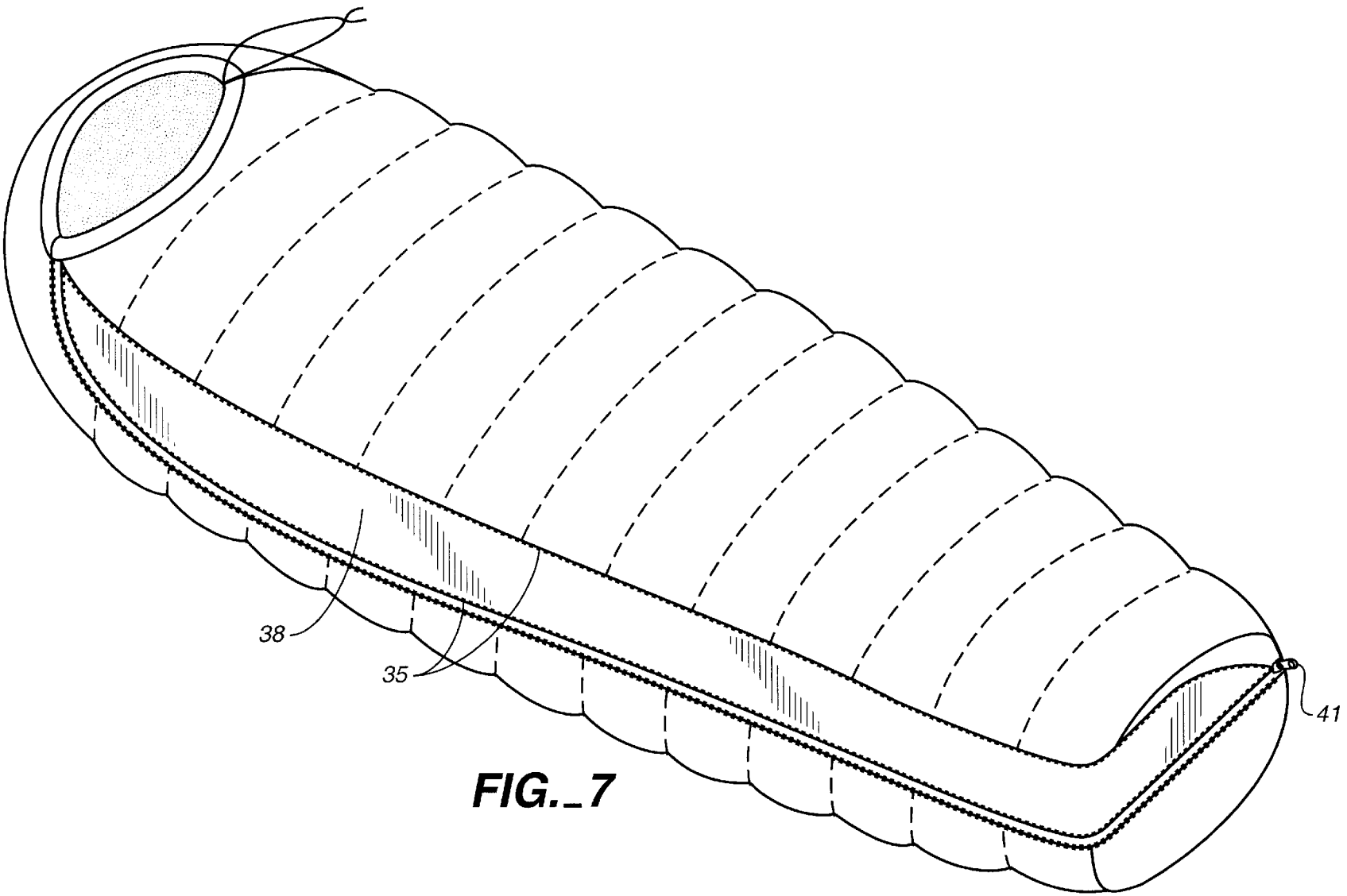
FIG. 7 is a perspective view of the present invention's modified draft tube and sleeping bag in an expanded state, further illustrating the sleeping bag expanded an additional amount in the user's foot area.

A final embodiment of the present invention allows the user to expand the sleeping bag in the user's foot area. As shown in FIGS. 4, 5 and 6, the draft tube modification features of the present invention are provided for a draft tube that only extends along one side of the sleeping bag, which is the usual location of prior art draft tubes. The present invention, however, includes the added feature of extending the draft tube 29, draft tube expansion segment 38, and expansion zipper 35 from a bottom edge of the sleeping bag, and then laterally across the bag's bottom end to an opposite bottom edge. Thus, as illustrated in FIG. 7, unzipping the expansion slider 41 of the expansion zipper 35 from the sleeping bag's head opening, longitudinally along the side of the sleeping bag, down to the bottom edge of the bottom end of the bag, and then laterally across the bottom end of the bag, expands the inner lining and outer shell, as well as the diametrical measurement of the bottom end of the bag.

It is to be understood that the present invention is not limited to the preferred embodiment and other embodiments described above, but encompasses any and all embodiments within the scope of the following claims.

What is claimed is:

1. A method of forming a draft tube for an expandable sleeping bag comprising the following steps:

a) forming an outer shell having first and second longitudinal shell edges defining a shell opening;

b) forming an inner lining disposed within the shell, said inner lining having first and second longitudinal lining edges defining a lining opening;

c) forming a draft tube having first and second longitudinal draft tube edges defining a draft tube opening;

d) forming an elongated draft tube expansion segment having first and second longitudinal expansion segment opposite edges;

e) forming an elongated front piece having first and second longitudinal front piece opposite edges;

f) providing an access means having first and second access attachment strips;

g) providing an expansion means having first and second expansion attachment strips;

h) forming a first seam by overlapping and attaching the first longitudinal shell and lining edges, and first access attachment strip;

i) forming a second seam by overlapping an attaching the first longitudinal draft tube edge, second access attachment strip, and first longitudinal front piece edge;

j) forming a third seam by overlapping and attaching the first longitudinal expansion segment edge, first expansion attachment strip, and second longitudinal front piece edge;

k) forming a fourth seam by overlapping and attaching the second longitudinal shell and lining edges, second longitudinal expansion segment edge, and second expansion attachment strip; and l) forming a fifth seam by overlapping and attaching the second longitudinal draft tube edge to the inner lining.

2. The method of claim 1 in which the access means is a zipper.

3. The method of claim 1 in which the expansion means is a zipper.

4. The method of claim 3 in which the expansion zipper has two zipper sliders.

5. The method of claim 1 in which the first, second, third, fourth and fifth seams are formed by sewing.

6. The method of claim 1 in which the draft tube and draft tube expansion segment extend substantially the entire length of the sleeping bag from the sleeping bag's head opening to the bottom edge the bag.

7. The method of claim 1 in which the draft tube and draft tube expansion segment extend substantially the entire length of the sleeping bag from the sleeping bag's head opening to the bottom edge of the bag, and extend laterally across the bottom of the bag to an opposite bottom edge.

8. The method of claim 1 in which the elongated draft tube expansion segment is substantially rectangular in shape.

9. The method of claim 1 in which the distance between the first and second longitudinal expansion segment opposite edges varies.

10. A expandable sleeping bag comprising:

a) an outer shell having first and second longitudinal shell edges defining a shell opening;

b) an inner lining disposed within the shell, said inner lining having first and second longitudinal lining edges defining a lining opening;

c) a draft tube having first and second longitudinal draft tube edges defining a draft tube opening;

d) a draft tube elongated expansion segment having first and second longitudinal expansion segment opposite edges;

e) an elongated front piece having first and second longitudinal front piece opposite edges;

f) an access means having first and second access attachment strips;

g) an expansion means having first and second expansion attachment strips;

h) a first seam formed by overlapping and attaching the first longitudinal shell and lining edges, and first access attachment strip;

i) a second seam formed by overlapping and attaching the first longitudinal draft tube edge, second access attachment strip, and first longitudinal front piece edge;

j) a third seam formed by overlapping and attaching the first longitudinal expansion segment edge, first expansion attachment strip, and second longitudinal front piece edge;

k) a fourth seam formed by overlapping and attaching the second longitudinal shell and lining edges, second longitudinal expansion segment edge, and second expansion attachment strip; and l) a fifth seam formed by overlapping and attaching the second longitudinal draft tube edge to the inner lining.

11. The sleeping bag of claim 10 in which the access means is a zipper.

12. The sleeping bag of claim 10 in which the expansion means is a zipper.

13. The sleeping bag of claim 12 in which the expansion zipper has two or more zipper sliders.

14. The sleeping bag of claim 10 in which the first, second, third, fourth and fifth of seams are formed by sewing.

15. The sleeping bag of claim 10 in which the draft tube and draft tube expansion segment extend substantially the entire length of the sleeping bag from the sleeping bag's head opening to the bottom edge of the bag.

16. The sleeping bag of claim 10 in which the draft tube and draft tube expansion segment extend the entire length of the sleeping bag from the sleeping bag's head opening to the bottom edge of the bag, and extend laterally across the bottom of the bag to an opposite bottom edge.

17. The sleeping bag of claim 10 in which the elongated draft tube expansion segment is substantially rectangular in shape.

18. The sleeping bag of claim 10 in which the distance between the first and second longitudinal expansion segment opposite edges varies.

* * * * *